US007827653B1

(12) United States Patent
Liu et al.

(10) Patent No.: US 7,827,653 B1
(45) Date of Patent: Nov. 9, 2010

(54) CLEANING DEVICE WITH SWEEPING AND VACUUMING FUNCTIONS

(75) Inventors: Chun-Hsien Liu, Taipei (TW); Tung-Chuan Wu, HsinChu (TW); Meng-Chun Chen, Tainan County (TW); Ya-Hui Tsai, Taoyuan County (TW)

(73) Assignee: Industrial Technology Research Institute, Hsin-Chu (TW)

( * ) Notice: Subject to any disclaimer, the term of this patent is extended or adjusted under 35 U.S.C. 154(b) by 0 days.

(21) Appl. No.: 12/565,489

(22) Filed: Sep. 23, 2009

(30) Foreign Application Priority Data

Aug. 25, 2009 (TW) ..... 98128483 A

(51) Int. Cl.
*A47L 5/10* (2006.01)

(52) U.S. Cl. ..... 15/383; 15/371

(58) Field of Classification Search ..... 15/371, 15/372, 383, 319, 340.3, 368, 393, 41.1, 15/52.1
See application file for complete search history.

(56) References Cited

U.S. PATENT DOCUMENTS 3,979,788 A * 9/1976 Strausak ..... 15/1.7
6,971,140 B2 12/2005 Kim
6,983,511 B2 * 1/2006 Massaro ..... 15/338
7,013,528 B2 * 3/2006 Parker et al. ..... 15/403
7,200,892 B2 4/2007 Kim
7,388,343 B2 * 6/2008 Jones et al. ..... 318/587
7,617,557 B2 * 11/2009 Reindle ..... 15/41.1
2008/0052846 A1 3/2008 Kapoor et al.
2008/0276407 A1 * 11/2008 Schnittman et al. ..... 15/319

* cited by examiner

*Primary Examiner*—Dung Van Nguyen
(74) *Attorney, Agent, or Firm*—WPAT, PC; Justin King

(57) ABSTRACT

A cleaning device with sweeping and vacuuming functions includes a body accommodating a sweep module and a vacuum module. A main brush and an auxiliary brush driven by a power unit are pivoted in the sweep module. The main brush partially extends outside an opening at a bottom of the sweep module and contacts a ground surface. The sweep module has an outlet adjacent to a top of the auxiliary brush, and is pivoted in the body to freely and pivotally swing under weight. A first chamber of a dust collector of the vacuum module has an inlet corresponding to the outlet, and trash removed by the sweep module is collected into the first chamber. An air inlet communicating with an air intake component is formed above a second chamber of the dust collector. A suction port is formed below the second chamber to draw dust into the second chamber.

13 Claims, 6 Drawing Sheets

CLEANING DEVICE WITH SWEEPING AND VACUUMING FUNCTIONS

BACKGROUND OF THE INVENTION

1. Field of Invention

The present invention relates to a vacuum cleaner, and more particularly to a cleaning device with sweeping and vacuuming functions realized by using a sweep module and a vacuum module to respectively clean up different types of trash.

2. Related Art

With the rapid development of automation technology and artificial intelligence, robots play an increasingly important role in the human environment. In recent years, service robots have undergone rapid development, with cleaning robots as the main application. The cleaning robots covers a wide range, and may be classified into industrial and domestic robots according to the International Federation of Robotics (IFR). Domestic floor cleaning robots (vacuum cleaners) have been growing rapidly in recent years, and have become the mainstream product in the market, with an annual output of more than 2.5 million units. It is estimated that the global production value of cleaning robots will grow by six times, from 300 million US dollars in 2007 to 1.8 billion US dollars in 2014, showing great development potential.

One consideration about cleaning robots is the cleaning performance, which varies with different designs of the brush and vacuum module. If only the vacuum module is used, a larger suction force is required for drawing heavy granular powder particles, resulting in increased power consumption and noises.

In addition to the design using only the vacuum module, a design combining the brush with the vacuum module also exists. For example, U.S. Pat. No. 6,971,140, entitled "Brush Assembly of Cleaner", proposes a cleaner assembled with plural brushes. The brushes are made of a flexible material and arranged at a bottom surface of the cleaner at regular intervals, and surround the outer circumference of a suction hole. A driving unit is connected to shafts of the brushes, and enables the brushes to continuously rotate around the circle. As such, dust and filth can be collected in a central area by the annularly arranged brushes, and then drawn through the suction hole, thereby improving the cleaning operation.

U.S. Pat. No. 7,200,892, entitled "Robot Cleaner with Adjustable Brush", proposes a structure with a brush which pivots in accordance with a condition of a floor surface to be cleaned. A suction port is formed behind the brush, and an airflow guiding design is provided between the brush and the suction port, such that dust and dirt removed by the brush are guided to the suction port, and then collected by suction. Such a brush structure prevents overload to a suction motor caused by excessive contact of the brush with the floor surface to be cleaned.

In addition, US Patent Application No. 20080052846, entitled "Cleaning Robot Roller Processing", proposes a robot, which includes a chassis, a drive system, and a cleaning assembly. The cleaning assembly includes a housing and at least one driven cleaning roller including an elongated core and a compliant flap. Cleaning bristles are mounted to be rotatable along a longitudinal axis of rotation, and extend radially outward from the core to the floor surface. The flap is configured to prevent hair or other filaments from spooling tightly about the core.

All the structural designs disclosed by the patents in the prior art are mainly characterized in that, the dust particles are moved toward the suction port, and then drawn in together.

However, the existing designs cannot achieve a high cleaning performance without increasing power consumption and noises, and thus need to be improved.

In view of the deficiencies and limitations of the conventional cleaning robots in actual applications, the inventor develops a cleaning device with sweeping and vacuuming functions through years of practical experience in research and development in the relevant industry.

SUMMARY OF THE INVENTION

Accordingly, the present invention is directed to a cleaning device with sweeping and vacuuming functions. For the cleaning device, a sweep module and a vacuum module are separately disposed, so as to reduce the requirement on the suction force of the suction motor, thereby lowering the noises and reducing the power consumption. Meanwhile, the cleaning performance is improved, so as to reduce the frequency in use of the cleaning device, thereby achieving the environment protection objectives of energy saving and reduction of $CO_2$ emission.

To achieve the above objectives, the cleaning device with sweeping and vacuuming functions includes a body, and a sweep module and a vacuum module disposed in the body.

A main brush and an auxiliary brush are pivoted in a casing of the sweep module, and the main brush and the auxiliary brush are driven by a power unit. An opening is formed at a bottom of the casing, such that a portion of the main brush extends out of the casing through the opening and contacts a ground surface. The casing has an outlet at a position adjacent to a top of the auxiliary brush, and is pivoted to the body, such that the sweep module freely and pivotally swings under a weight thereof.

A dust collector of the vacuum module has a first chamber and a second chamber disposed therein. The first chamber has an inlet corresponding to the outlet of the sweep module, such that trash removed by the sweep module is collected into the first chamber. An air inlet in communication with an air intake component is formed above the second chamber. A suction port is formed below the second chamber, such that the air intake component generates a suction force to draw dust into the second chamber.

Therefore, the present invention can respectively clean up different types of trash, that is, clean up heavy trash with the sweep module, and clean up dust with the vacuum module, such that the load of the vacuum module is greatly reduced, the noises caused by dust suction are lowered, and the cleaning efficiency is improved.

Moreover, the dual-brush design combining the main brush with the auxiliary brush can effectively prevent the operation of the brushes from being affected by trash trapped in the brushes. The position of the freely pivoted sweep module can be automatically adjusted by the weight thereof, so as to maintain the contact with the ground surface, thereby achieving a better sweeping effect.

In order to make the aforementioned advantages and features of the present invention comprehensible, embodiments accompanied with figures are described in detail below.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Embodiments of the present invention are illustrated in detail below with reference to the accompanying drawings.

Figure 1:
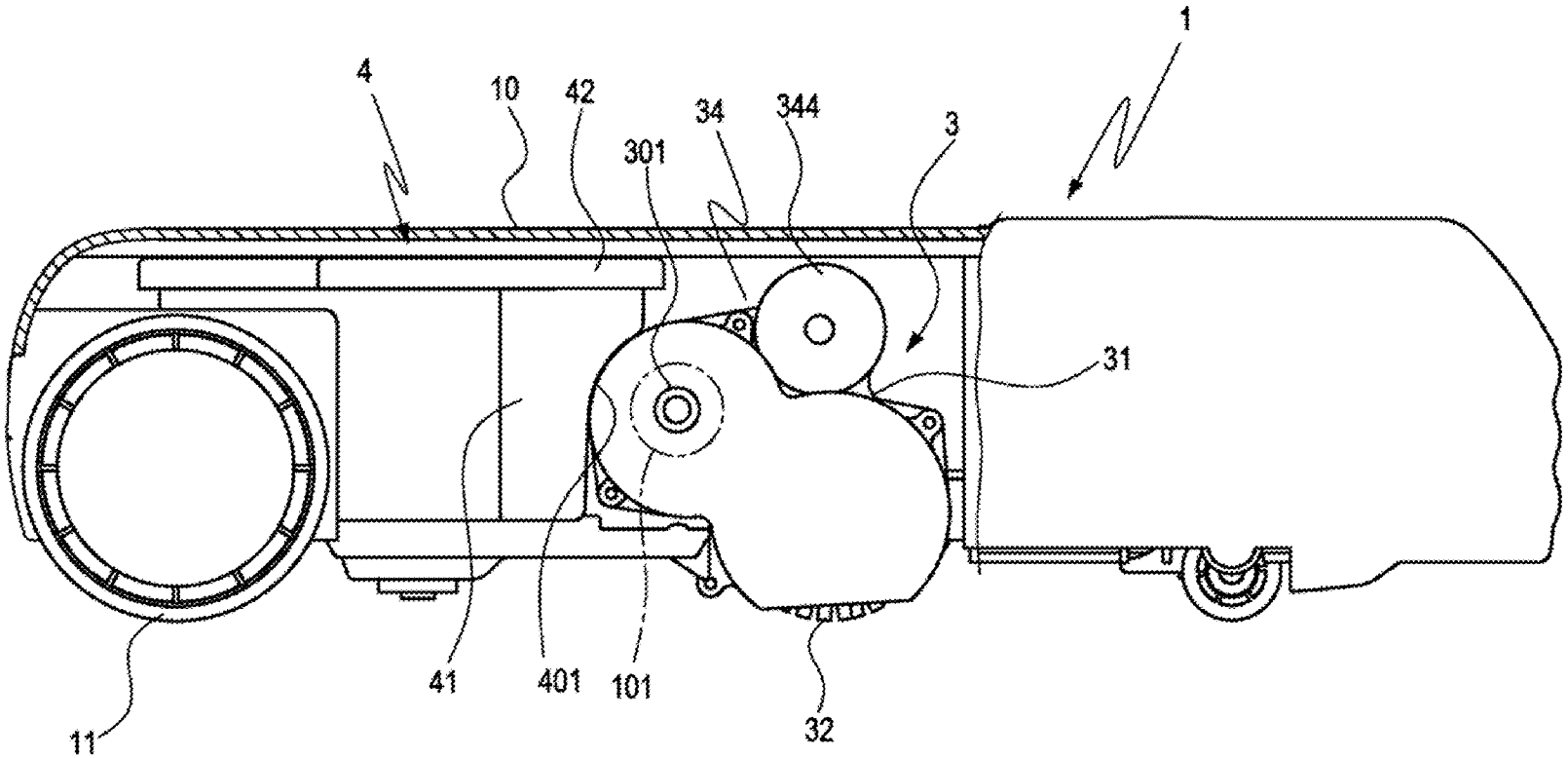
FIG. 1 is a schematic structural view of a self-propelled vacuum cleaner according to the present invention.
Figure 2:
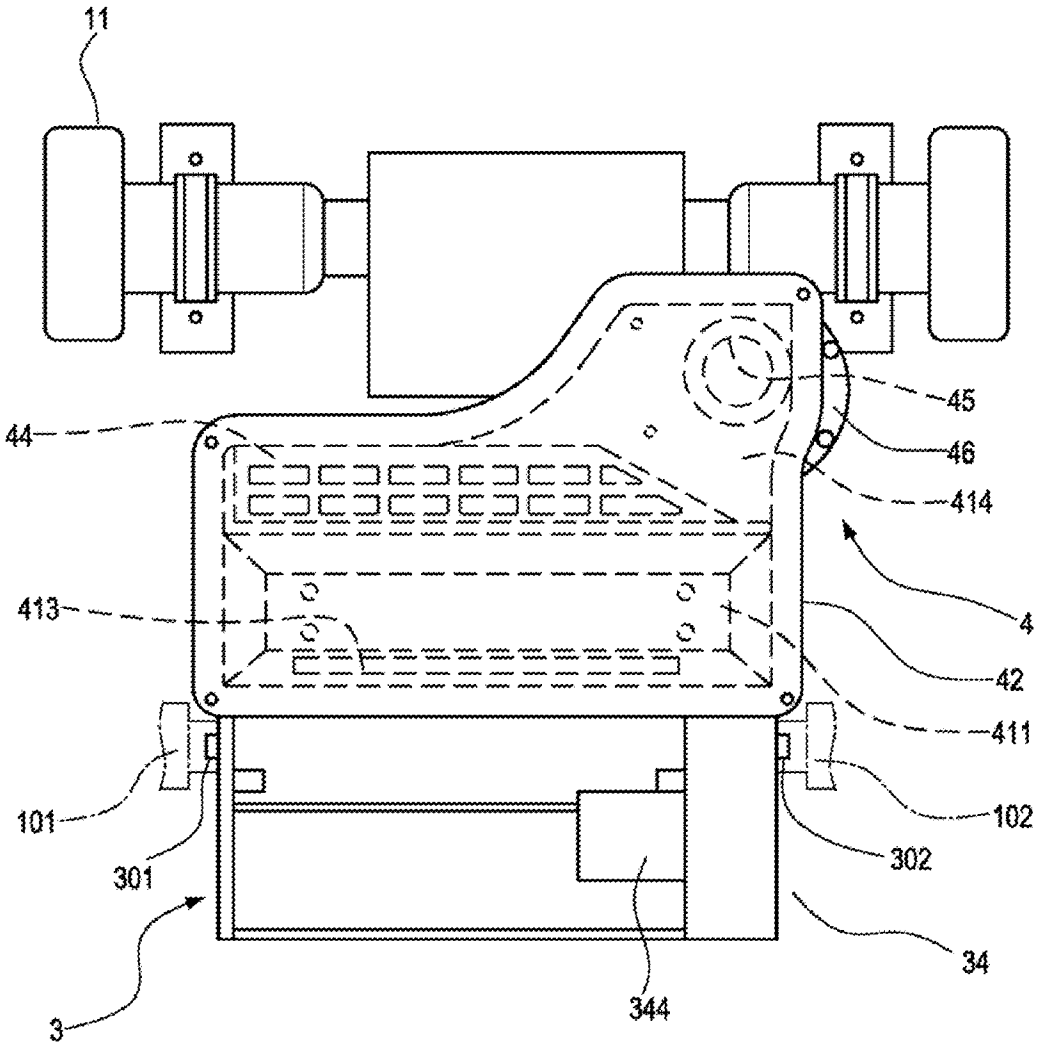
FIG. 2 is a schematic view of a structural configuration of the present invention.
Figure 3:
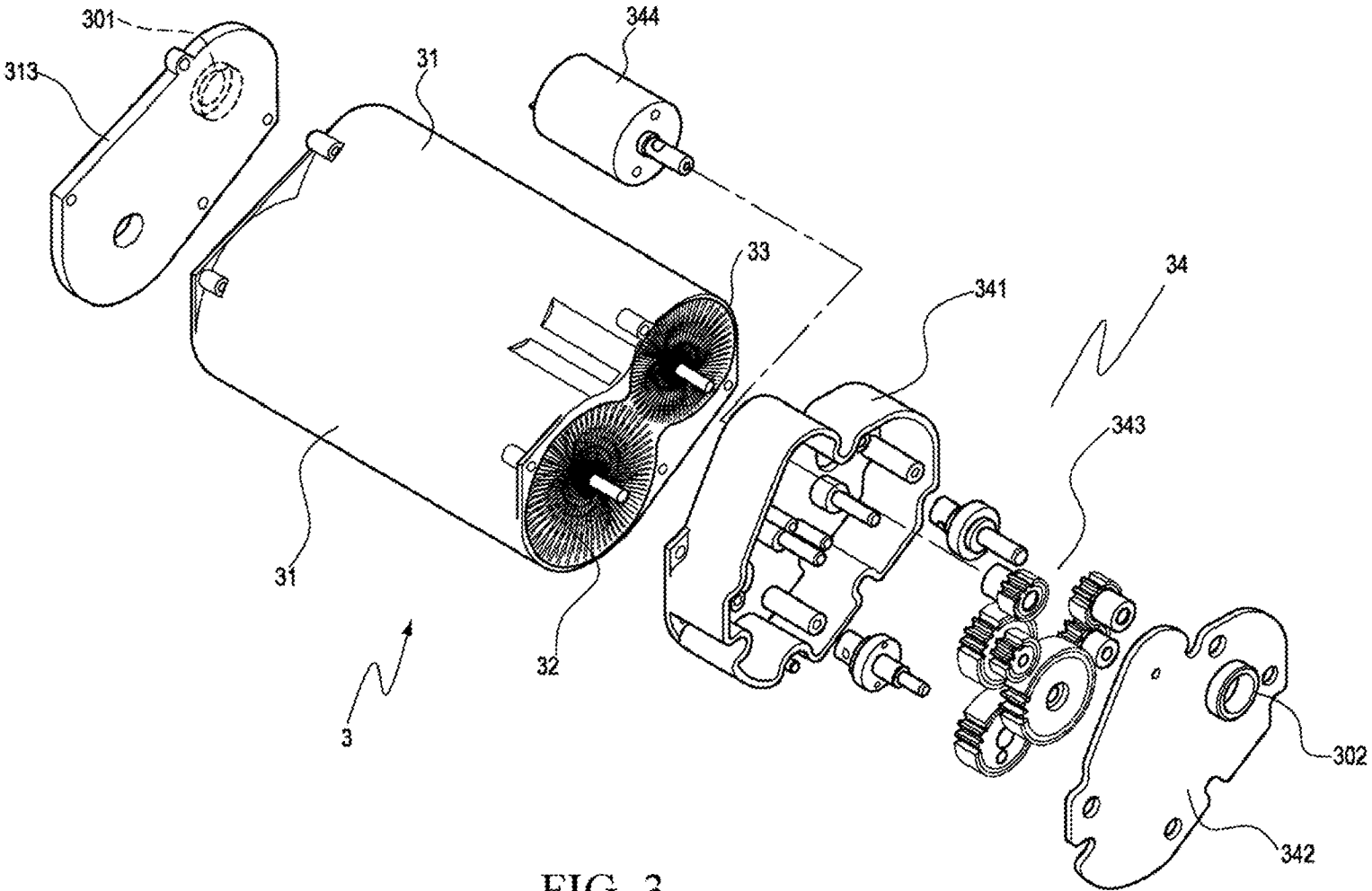
FIG. 3 is a three-dimensional exploded view of a sweep module according to the present invention.
Figure 4:
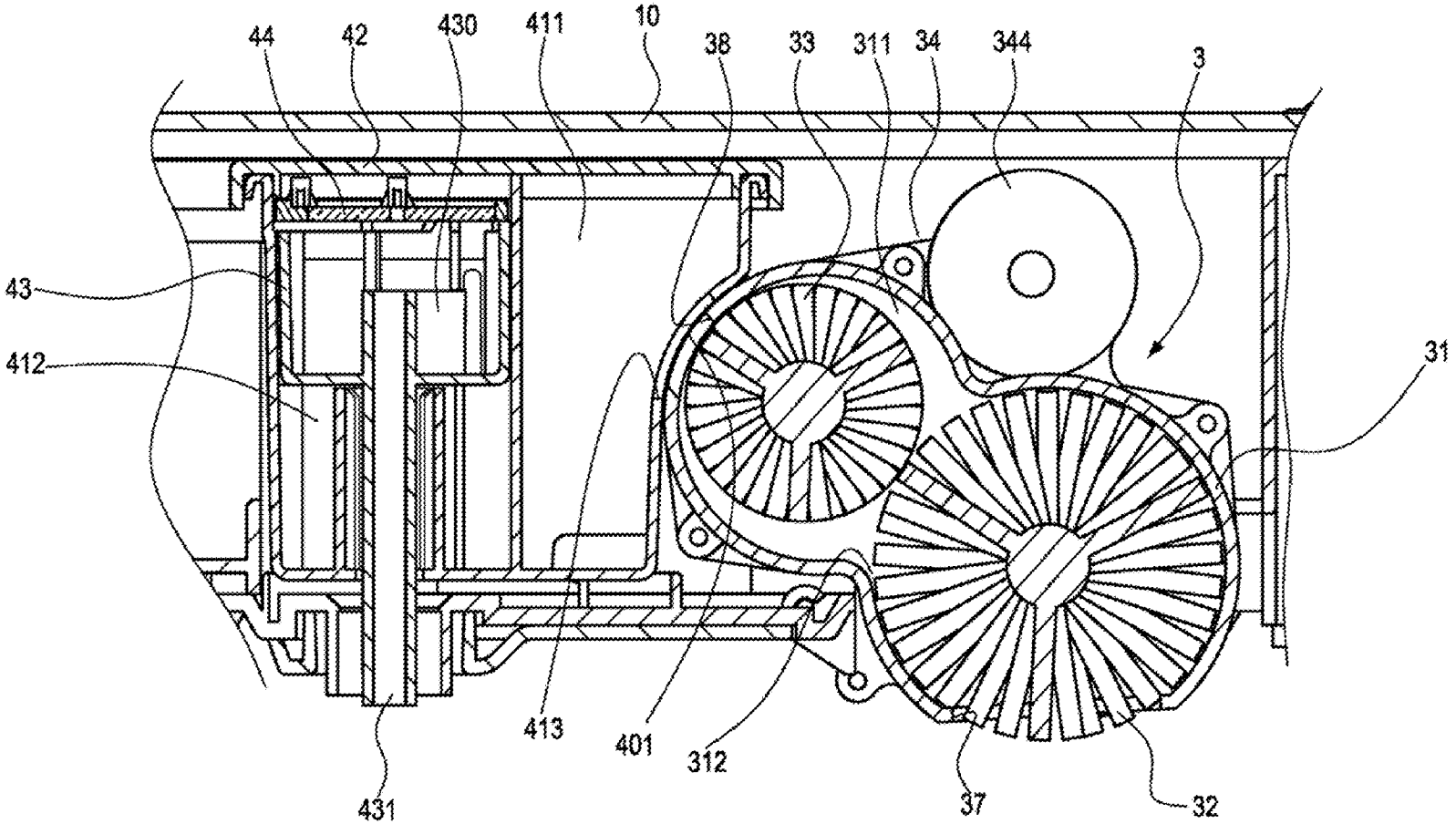
FIG. 4 is a schematic cross-sectional structural view of a sweep module and a vacuum module according to the present invention.
Figure 5:
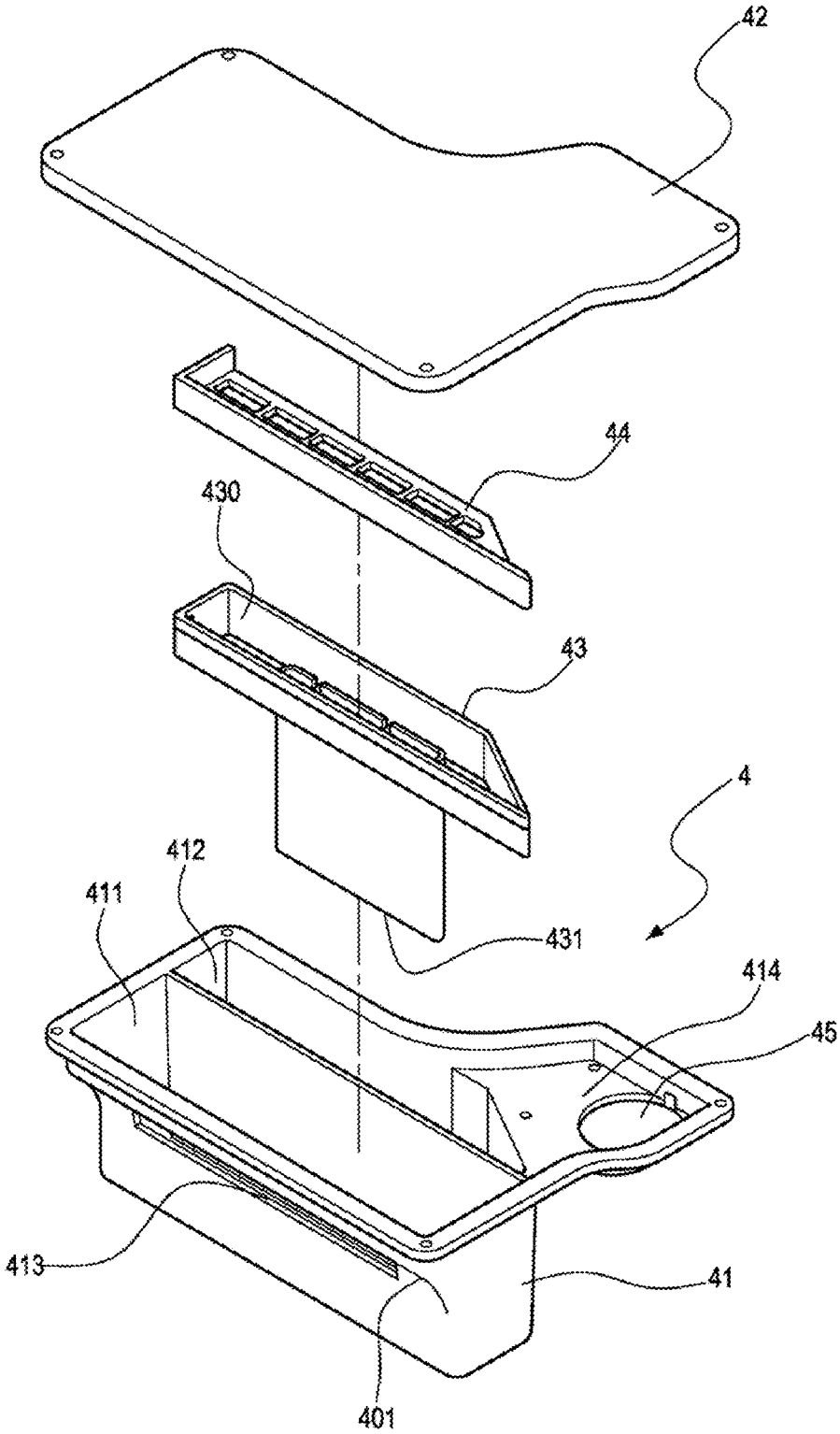
FIG. 5 is a three-dimensional partially-exploded view of a vacuum module according to the present invention.

Reference is made to FIGS. 1 to 5. FIG. 1 is a schematic cross-sectional structural view of a self-propelled vacuum cleaner according to the present invention; FIG. 2 is a schematic view of a structural configuration of the present invention; FIG. 3 is a three-dimensional exploded view of a sweep module according to the present invention; FIG. 4 is a schematic cross-sectional structural view of a sweep module and a vacuum module according to the present invention; and FIG. 5 is a three-dimensional exploded view of a dust collector of a vacuum module according to the present invention.

The cleaning device with sweeping and vacuuming functions of the present invention refers to a cleaning device such as a self-propelled vacuum cleaner or a conventional vacuum cleaner. The following embodiment is illustrated by taking a self-propelled vacuum cleaner as an example.

The self-propelled vacuum cleaner 1 in this embodiment has an approximately flat disk-shaped body 10. The body 10 has a self-propelled mechanism required by the self-propelled vacuum cleaner 1. In order to achieve both sweeping and vacuuming functions, in the present invention, a sweep module 3 and a vacuum module 4 are disposed at middle and rear portions of the body 10 adjacent to a rear wheel assembly 11 of the self-propelled vacuum cleaner 1.

The sweep module 3 has a casing 31. The casing 31 has an approximately 8-shaped cross-section, and has an upper chamber 311 and a lower chamber 312 disposed therein. The lower chamber 312 is used for accommodating a main brush 32, and the upper chamber 311 is used for accommodating an auxiliary brush 33. A side plate 313 is disposed on one side of the casing 31, and used for enclosing one side of the upper chamber 311 and the lower chamber 312. The main brush 32 and the auxiliary brush 33 are driven by a power unit 34. In this embodiment, the power unit 34 is provided with a gear box 341 on one side of the casing 31 opposite to the side plate 313. A cover plate 342 is disposed on one side of the gear box 341, and used for enclosing the gear box 341. A gear train 343 is disposed in the gear box 341. The gear train 343 is driven by a motor 344 combined with the gear box 341, and the main brush 32 and the auxiliary brush 33 are respectively linked to the gear train 343, such that the motor 344 synchronously drives the main brush 32 and the auxiliary brush 33 to rotate.

The power unit of the present invention is not limited to the configuration using a motor to synchronously drive the main brush and the auxiliary brush, and may also be configured to use two motors to respectively drive the main brush and the auxiliary brush.

A pivoting member 301, 302 is respectively disposed at opposing positions on the side plate 313 and the cover plate 342 of the gear box 341. A pivoting portion 101, 102 corresponding to the two pivoting members 301, 302 respectively protrudes from the body 10, such that the two pivoting members 301, 302 are pivoted in the two pivoting portions 101, 102, and the sweep module 3 freely and pivotally swings about the two pivoting members 301, 302. As such, the sweep module 3 pivotally swings under the weight thereof with the changes of the height of the ground surface, so as to maintain the main brush 32 in contact with the ground surface.

An opening 37 is formed at a bottom of the lower chamber 312 of the casing 31, such that a portion of the main brush 32 extends out of the casing 31 through the opening 37 and contacts the ground surface. The upper chamber 311 has an outlet 38 at a portion thereof adjacent to the vacuum module 4, and the outlet 38 is adjacent to a top of the auxiliary brush 33.

The vacuum module 4 has a dust collector 41 and a detachable cover 42.

The dust collector 41 has a first chamber 411 and a second chamber 412 disposed therein. The first chamber 411 and the second chamber 412 are enclosed and separated from each other by the cover 42. The dust collector 41 has a circular arc-shaped surface 401 at one side of an outer circumference thereof closely adjacent to the sweep module 3 and corresponding to the casing 31 of the sweep module 3, such that when the sweep module 3 pivotally swings about the two pivoting members 301, 302, the circular arc-shaped surface 401 is closely adjacent to the casing 31 without contacting the casing 31.

The first chamber 411 is located at one side of the dust collector 41 adjacent to the sweep module 3, and the second chamber 412 is located at one side of the dust collector 41 far away from the sweep module 3. The first chamber 411 has an inlet 413 corresponding to the outlet 38 of the casing 31 of the sweep module 3, such that trash removed by the sweep module 3 is collected from the outlet 38 of the sweep module 3 into the first chamber 411 through the inlet 413.

The second chamber 412 is configured to downwardly insert a dust collection groove 43 therein. The dust collection groove 43 has a dust collection chamber 430 and a suction port 431 extending downward from the dust collection chamber 430. The suction port 431 may extend downward out of the second chamber 412. A dust collection screen 44 is disposed on one side of the dust collection chamber 430 far away from the suction port 431. A guiding portion 414 extends from one side of the second chamber 412. The dust collector 41 has an air inlet 45 at the guiding portion 414. The air inlet 45 is in communication with an air intake component 46. After a suction force generated by the air intake component 46 is transmitted to the guiding portion 414 through the air inlet 45, an upward suction force is generated in the dust collection groove 43, such that dust is sucked up into the dust collection chamber 430 through the suction port 431 at the bottom of the dust collection groove 43, filtered by the dust collection screen 44, and then collected into the bottom of the dust collection chamber 430.

Figure 6:
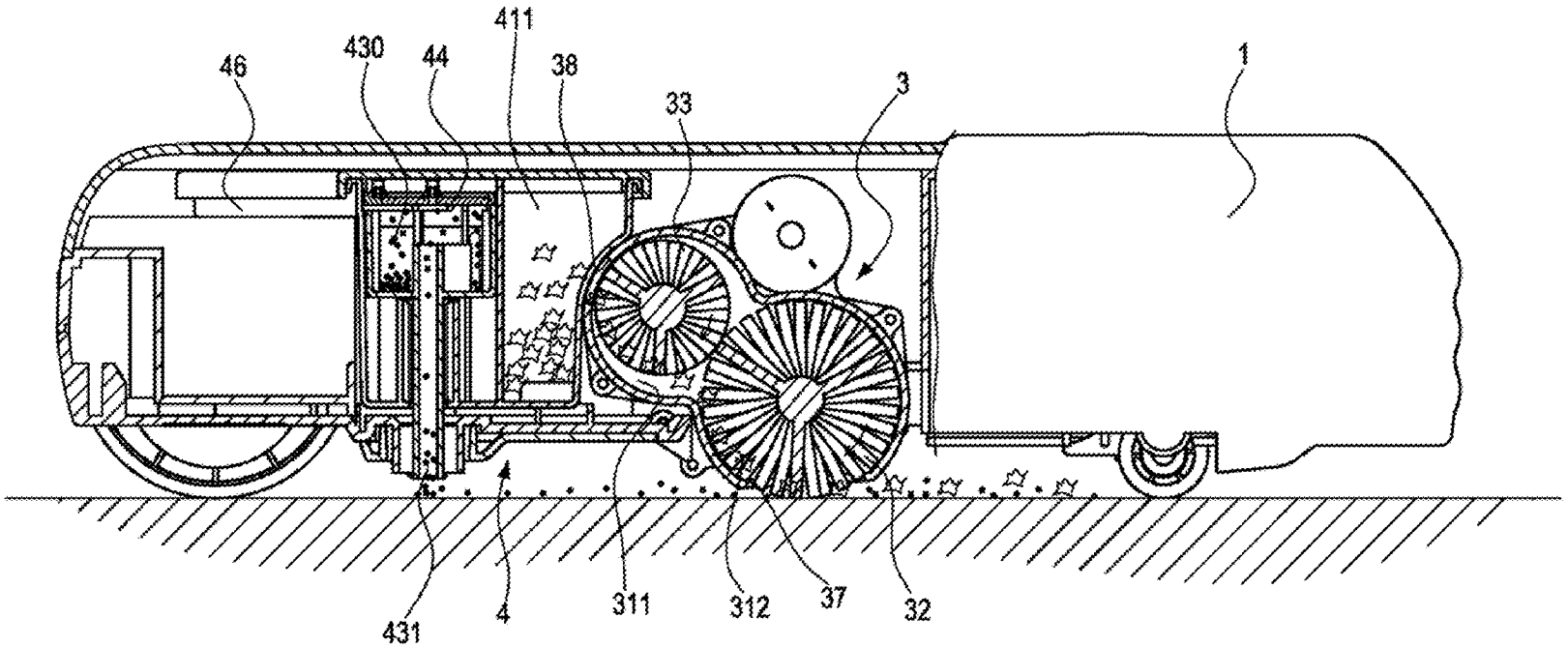
FIG. 6 is a schematic view of the present invention in use.

FIG. 6 is a schematic view of the present invention in use. Referring to FIG. 6, when the self-propelled vacuum cleaner 1 of this embodiment moves on the ground surface, since the sweep module 3 is located in the front of the vacuum module 4, and the sweep module 3 can maintain the contact force between the main brush 32 and the ground surface under the weight of the sweep module 3, trash, hair, large dust particles, and the like on the ground surface are firstly swept by the main brush 32 of the sweep module 3 into the lower chamber 312 through the opening 37, guided into the upper chamber 311 along a tangential line of the main brush 32, delivered backward by the auxiliary brush 33, and finally delivered and collected into the first chamber 411 along a tangential line of the auxiliary brush 33 through the outlet 38.

The main brush 32 and the auxiliary brush 33 synchronously rotate in the same direction, and the main brush 32 is in slight contact with the auxiliary brush 33, so that when hair is adhered to the main brush 32, the hair will be removed by the auxiliary brush 33, thereby preventing the hair from accumulating in the main brush 32.

After the trash, hair, large dust particles, and the like on the ground surface are removed by the sweep module 3, only dust particulates are left on the ground surface. The dust particulates will be drawn by the suction force generated by the suction port 431 of the vacuum module 4, introduced into the dust collection chamber 430 through the suction port 431, filtered by the dust collection screen 44, and then collected into the dust collection chamber 430.

Since the sweep module 3 and the vacuum module 4 are separately disposed in the present invention, the present invention has both sweeping and vacuuming functions. The sweep module 3 removes trash, hair, large dust particles, and the like, so the vacuum module 4 only needs to draw dust particulates. In this manner, the dust collection chamber 430 may be designed to have a small size, and the air intake component 46 only requires a small power source, thereby reducing the power consumption, lowering the noises caused by dust suction, and improving the cleaning efficiency.

Since the sweep module 3 is freely pivoted in the body 10 of the self-propelled vacuum cleaner 1, the sweep module 3 generates a downward force by the weight thereof, so as to maintain the main brush 32 in contact with the ground surface, thereby ensuring that trash, hair, dust, and the like on the ground surface are swept up and collected into the first chamber 411.

Since the main brush 32 and the auxiliary brush 33 capable of synchronous rotation are disposed in the sweep module 3, and the main brush 32 is in slight contact with the auxiliary brush 33, it effectively prevents the operation of the brush from being affected by trash trapped in the main brush 32.

Moreover, the dust collection groove 43 of the vacuum module 4 is downwardly inserted into the second chamber 412, and is enclosed and fixed by the cover 42, so that when a user intends to clean the dust collection groove 43, the user only needs to open the cover 42, and upwardly pull the dust collection groove 43 out of the second chamber 412 for cleaning, which is quite convenient.

To sum up, the present invention can respectively clean up different types of trash, that is, clean up heavy trash by sweeping, and clean up dust by suction, such that the load of the vacuum module is greatly reduced, the noises caused by dust suction are lowered, and the cleaning efficiency is improved. Moreover, the dual-brush design combining the main brush with the auxiliary brush can effectively prevent the operation of the brushes from being affected by trash trapped in the brushes. The position of the freely pivoted sweep module can be automatically adjusted by the weight thereof, so as to maintain the contact with the ground surface, thereby achieving a better sweeping effect. The design of the vertical dust collection groove facilitates the user to clean up the trash from above the vacuum cleaner.

Although the present invention is disclosed above through several embodiments, the embodiments are not intended to limit the present invention. Equivalent replacements such as variations and modifications made by persons skilled in the art without departing from the spirit and scope of the present invention shall fall within the protection scope of the present invention.

What is claimed is:

1. A cleaning device with sweeping and vacuuming functions, comprising:

a body;

a sweep module, disposed in the body, wherein the sweep module has a casing, a main brush and an auxiliary brush are pivoted in the casing, the main brush and the auxiliary brush are driven by a power unit, the casing is pivoted to the body such that the sweep module freely and pivotally swings under a weight thereof, an opening is formed at a bottom of the casing such that a portion of the main brush extends out of the casing through the opening and contacts a ground surface, the casing has an outlet at a portion thereof adjacent to the vacuum module, and the outlet is adjacent to a top of the auxiliary brush; and a vacuum module, disposed in the body and adjacent to the sweep module, wherein the vacuum module has a dust collector, the dust collector has a first chamber and a second chamber disposed therein, the first chamber is located at one side of the dust collector adjacent to the sweep module, the first chamber has an inlet corresponding to the outlet of the sweep module such that trash removed by the sweep module is collected into the first chamber, a suction port is formed below the second chamber, an air inlet is formed above the second chamber, and the air inlet is in communication with an air intake component, such that the air intake component generates a suction force to draw dust into the second chamber.

2. The cleaning device with sweeping and vacuuming functions according to claim 1, wherein the casing has an approximately 8-shaped cross-section and has an upper chamber and a lower chamber, the lower chamber is used for accommodating the main brush, and the upper chamber is used for accommodating the auxiliary brush.

3. The cleaning device with sweeping and vacuuming functions according to claim 2, wherein the opening is located at a bottom of the lower chamber, and the outlet is located at a portion of the upper chamber adjacent to the vacuum module.

4. The cleaning device with sweeping and vacuuming functions according to claim 1, wherein a side plate is disposed on one side of the casing, and one side of the casing opposite to the side plate is combined with the power unit.

5. The cleaning device with sweeping and vacuuming functions according to claim 1, wherein the power unit has a gear box, a gear train is disposed in the gear box, the gear train is driven by a motor, and the main brush and the auxiliary brush are respectively linked to the gear train.

6. The cleaning device with sweeping and vacuuming functions according to claim 5, wherein a cover plate is disposed on one side of the gear box opposite to the casing, and used for enclosing the gear box.

7. The cleaning device with sweeping and vacuuming functions according to claim 1, wherein the power unit uses two motors to respectively drive the main brush and the auxiliary brush.

8. The cleaning device with sweeping and vacuuming functions according to claim 1, wherein a pivoting member is respectively disposed at two sides of the casing of the sweep module, and a pivoting portion corresponding to the two pivoting members respectively protrudes from the body, such that the two pivoting members are pivoted in the two pivoting portions, and the casing pivotally swings about the two pivoting members.

9. The cleaning device with sweeping and vacuuming functions according to claim 8, wherein a side plate is disposed on one side of the casing, an other side of the casing is combined with the power unit, a cover plate is disposed on one side of the power unit opposite to the casing, and the two pivoting portions are respectively located at opposing positions on the side plate and the cover plate.

10. The cleaning device with sweeping and vacuuming functions according to claim 1, wherein the dust collector has a detachable cover, and the first chamber and the second chamber are enclosed and separated from each other by the cover.

11. The cleaning device with sweeping and vacuuming functions according to claim 1, wherein the second chamber is configured to downwardly insert a dust collection groove therein, the dust collection groove has a dust collection chamber, the dust collection chamber extends downward from the second chamber to form the suction port, and a dust collection screen is disposed on one side of the dust collection chamber far away from the suction port.

12. The cleaning device with sweeping and vacuuming functions according to claim 1, wherein a guiding portion extends from the second chamber, and the air inlet is located at the guiding portion.

13. The cleaning device with sweeping and vacuuming functions according to claim 1, wherein the dust collector has a circular arc-shaped surface at one side of an outer circumference thereof closely adjacent to the sweep module and corresponding to the casing of the sweep module, such that when the sweep module freely and pivotally swings, the circular arc-shaped surface is closely adjacent to the casing without contacting the casing.

* * * * *